US012396546B2

(12) United States Patent
Vollmer

(10) Patent No.: US 12,396,546 B2
(45) Date of Patent: Aug. 26, 2025

(54) BACKPACK WITH HEATING AND COOLING ELEMENTS

(71) Applicant: Dimitri Vollmer, Lakewood, WA (US)

(72) Inventor: Dimitri Vollmer, Lakewood, WA (US)

( * ) Notice: Subject to any disclaimer, the term of this patent is extended or adjusted under 35 U.S.C. 154(b) by 65 days.

(21) Appl. No.: 18/389,545

(22) Filed: Nov. 14, 2023

(65) Prior Publication Data

US 2025/0151879 A1 May 15, 2025

(51) Int. Cl.

| | |
|---|---|
| ***A45F 3/02*** | (2006.01) |
| ***A63B 60/60*** | (2015.01) |
| ***A63B 71/00*** | (2006.01) |
| *A45F 3/00* | (2006.01) |
| *A45F 5/00* | (2006.01) |

(52) U.S. Cl.

CPC ..... *A45F 3/02* (2013.01); *A63B 60/60* (2015.10); *A63B 71/0045* (2013.01); *A45F 2003/001* (2013.01); *A45F 2005/002* (2013.01)

(58) Field of Classification Search

CPC ..... A45F 3/02; A45F 2003/001; A45F 2005/002; A63B 60/60; A63B 71/0045

USPC ..... 206/315.1

See application file for complete search history.

(56) References Cited

U.S. PATENT DOCUMENTS

| | | | | |
|---|---|---|---|---|
| 4,693,402 | A * | 9/1987 | Comeau | A45F 3/04 224/604 |
| D370,560 | S | 6/1996 | Doerbaum | |
| 6,229,132 | B1 | 5/2001 | Knetter | |
| 7,004,317 | B2 | 2/2006 | Severa | |
| 7,278,539 | B2 * | 10/2007 | Souza | A45C 3/00 190/110 |
| 7,395,930 | B2 * | 7/2008 | Tauchen | A45C 3/00 206/315.9 |
| 8,820,523 | B1 | 9/2014 | Breza | |
| 2003/0042157 | A1 * | 3/2003 | Mays | A45C 13/10 206/315.9 |
| 2006/0151345 | A1 * | 7/2006 | Coffing | A45C 5/00 206/315.1 |
| 2006/0207898 | A1 | 9/2006 | Cheng | |
| 2007/0164064 | A1 * | 7/2007 | Nathan | A45F 3/04 224/153 |
| 2008/0011568 | A1 * | 1/2008 | Siwak | A45C 13/28 190/115 |
| 2010/0176012 | A1 * | 7/2010 | Carter | A45F 5/1566 206/315.3 |
| 2011/0174583 | A1 * | 7/2011 | Yoneno | A45C 13/28 190/103 |
| 2012/0097495 | A1 * | 4/2012 | Moore | A45C 13/08 190/110 |
| 2013/0233661 | A1 * | 9/2013 | Scott | A45F 3/047 190/102 |

(Continued)

FOREIGN PATENT DOCUMENTS

| | | |
|---|---|---|
| EP | 1352674 | 10/2003 |

*Primary Examiner* — Jacob K Ackun

(57) ABSTRACT

A heating and cooling backpack apparatus for storing baseball bats and selectively heating and cooling parts of the bag includes a body having an outer shell which defines an interior space. A carrying strap is coupled to a back side of the body and a bat sleeve is coupled to the body for holding a baseball bat or similar sports equipment. A bat heater selectively heats the bat sleeve, and a back heater cooler selectively heats and selectively cools an outer surface of the body across the back side.

18 Claims, 9 Drawing Sheets

(56) References Cited

U.S. PATENT DOCUMENTS

| | | | | |
|---|---|---|---|---|
| 2014/0262661 | A1* | 9/2014 | Mathieu | A45C 5/14<br>16/45 |
| 2017/0251781 | A1 | 9/2017 | Wilson | |
| 2019/0183235 | A1 | 6/2019 | Yang | |

* cited by examiner

BACKPACK WITH HEATING AND COOLING ELEMENTS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sports equipment bags and more particularly pertains to a new sports equipment bag for storing baseball bats and selectively heating and cooling parts of the bag.

(2) Description of Related Art Including Information Disclosed Under 37 CFR 1.97 and 1.98

The prior art relates to sports equipment bags including various means for heating or cooling contents of the bag such as baseball bats. The prior art collectively fails to address a sports equipment bag for selectively heating baseball bats while selectively heating and cooling a back side of the back for the comfort of a user.

BRIEF SUMMARY OF THE INVENTION

An embodiment of the disclosure meets the needs presented above by generally comprising a body having an outer shell which defines an interior space. A carrying strap is coupled to and extends outwardly from the body. The carrying strap extends from a back side of the body adjacent to a top side of the body to the back side of the body adjacent to a bottom side of the body. A bat sleeve is coupled to an outer surface of the body and comprises a tubular panel. The bat sleeve also has an open top and a closed bottom and is configured for holding a baseball bat. A bat heater is coupled to the bat sleeve and selectively heats the bat sleeve. A back heater cooler is coupled to the back side of the body. The back heater cooler selectively heats and selectively cools the outer surface of the body across the back side. A control circuit is coupled to the body and is positioned within the interior space. The control circuit is electrically coupled to the bat heater and the back heater cooler.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
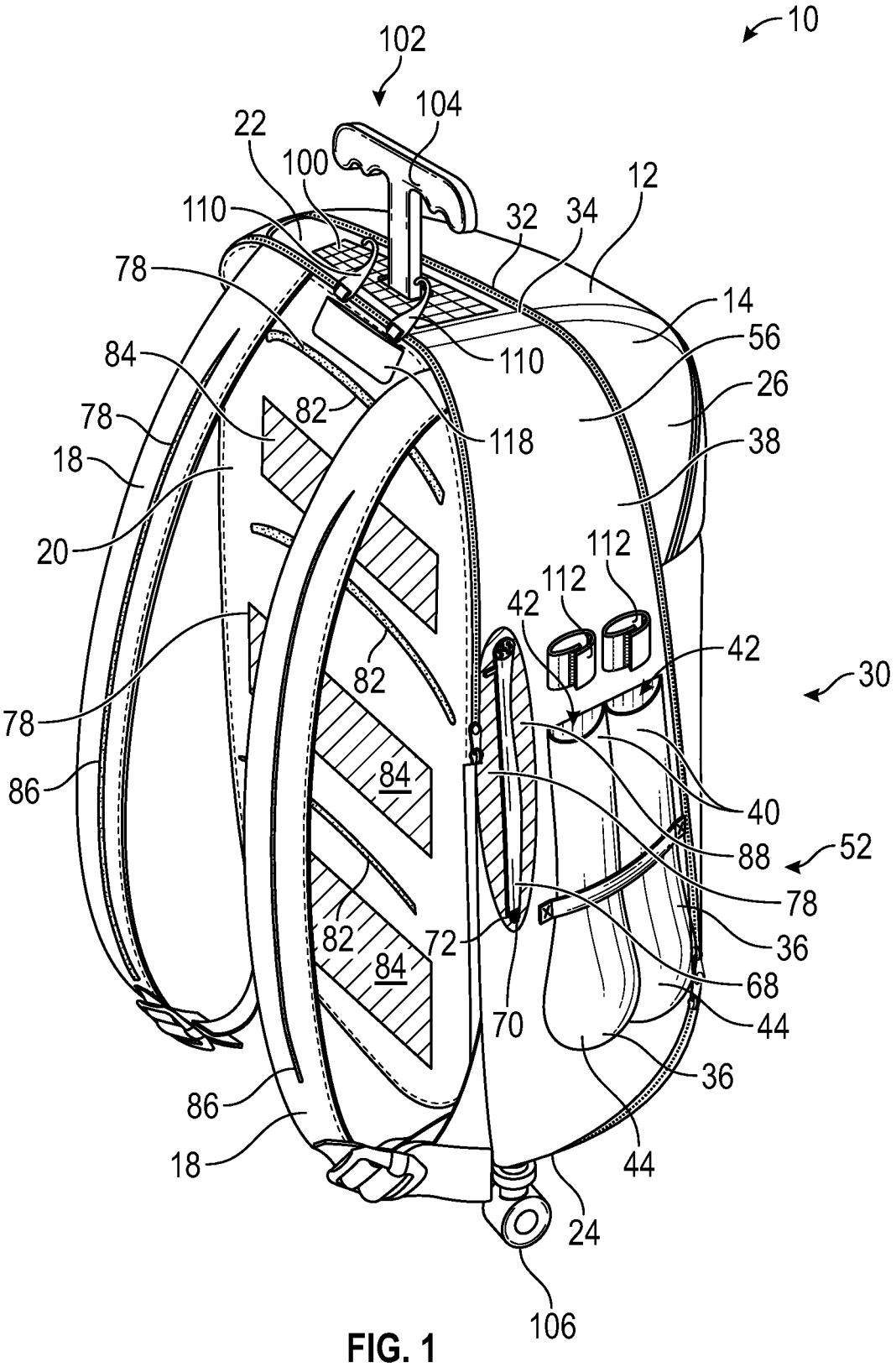
FIG. 1 is a top back side perspective view of a heating and cooling backpack apparatus according to an embodiment of the disclosure.
Figure 2:
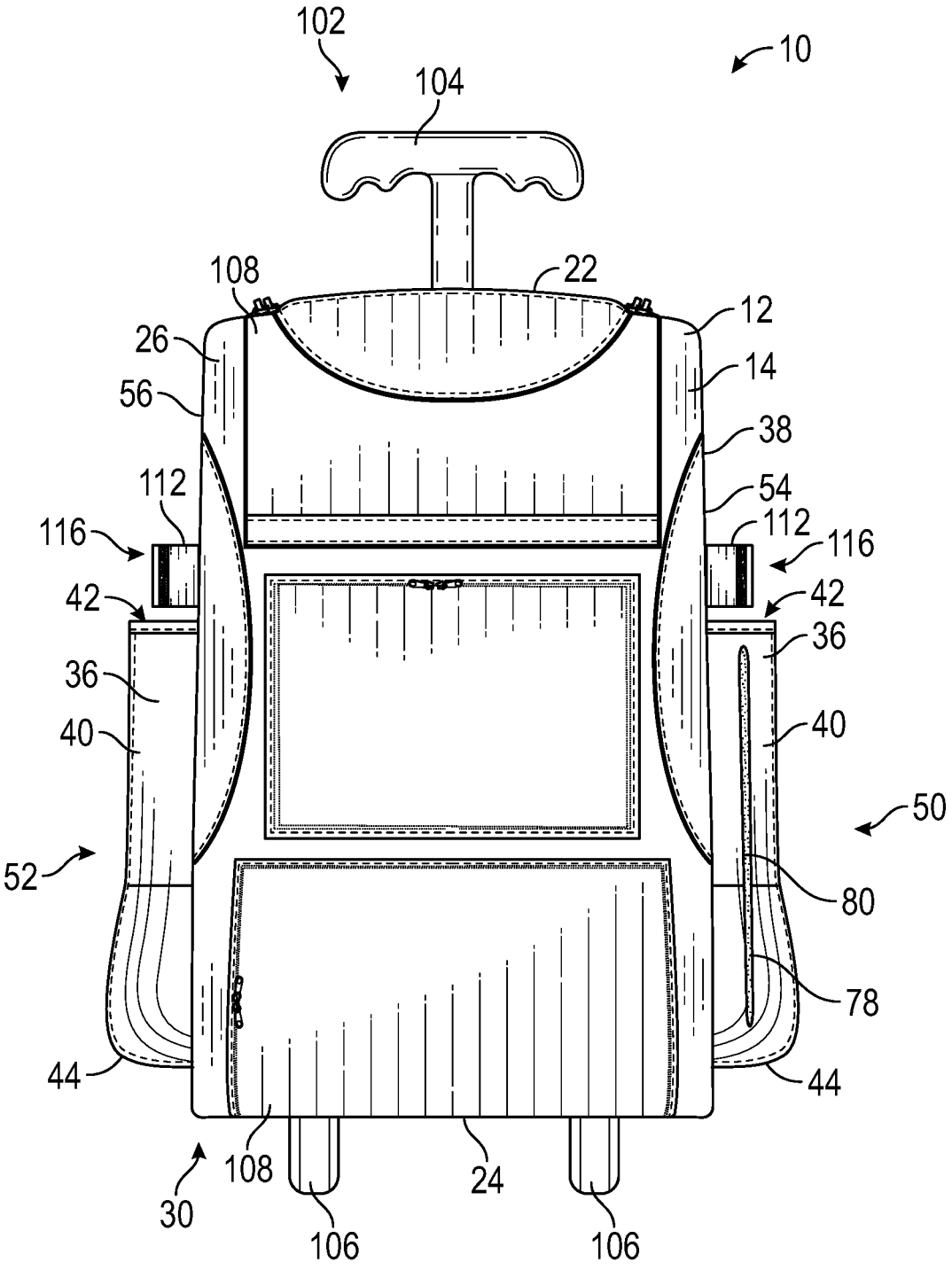
FIG. 2 is a front view of an embodiment of the disclosure.
Figure 3:
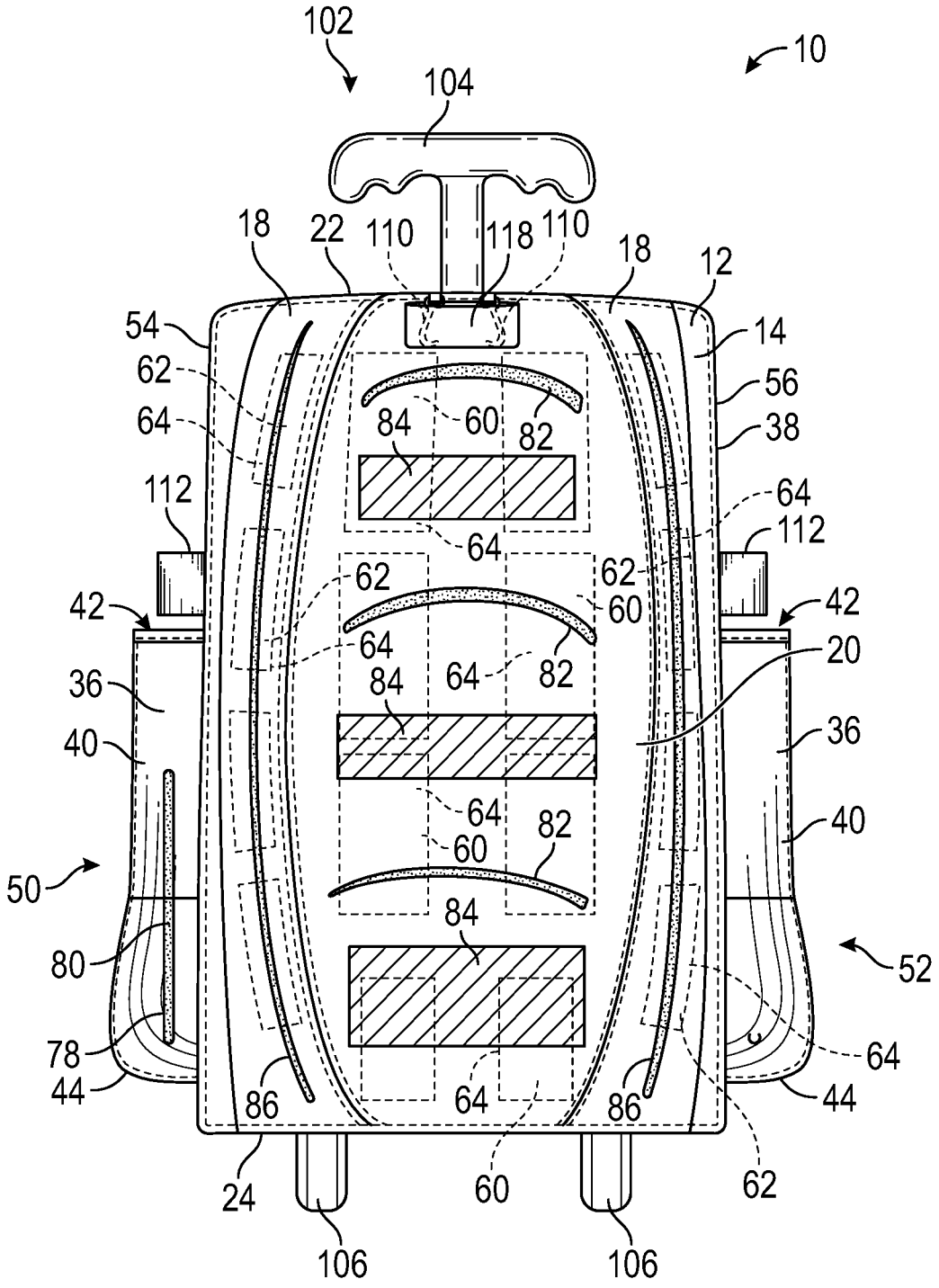
FIG. 3 is a back view of an embodiment of the disclosure.
Figure 4:
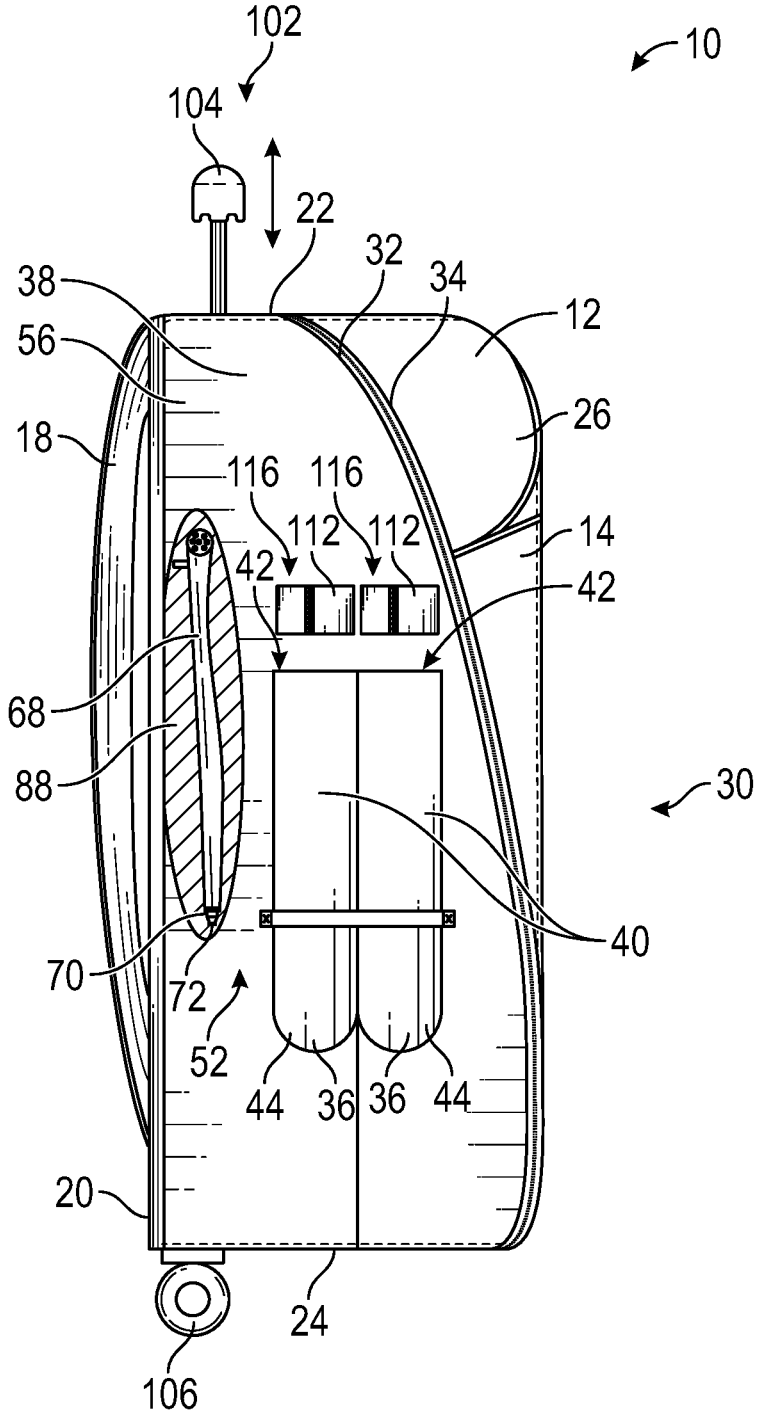
FIG. 4 is a second side view of an embodiment of the disclosure.
Figure 5:
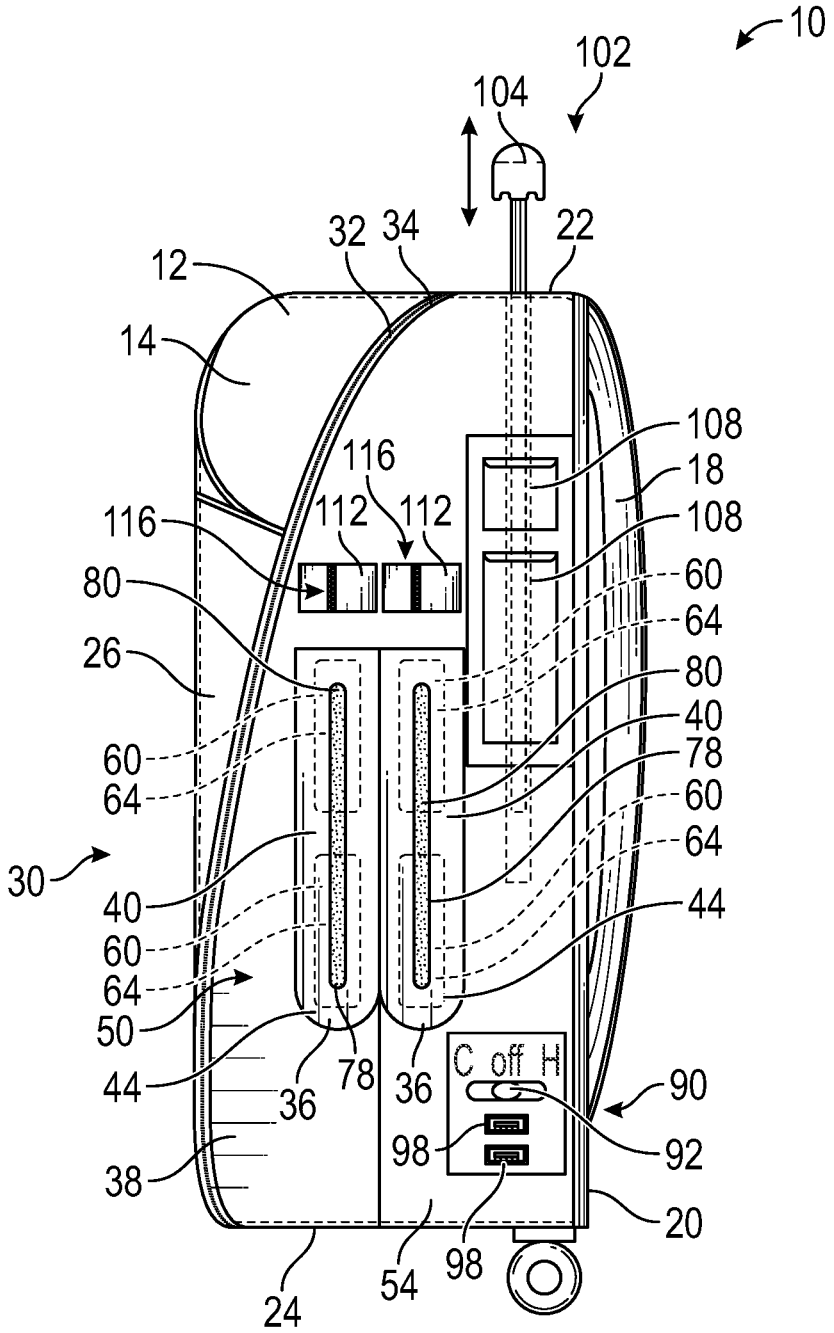
FIG. 5 is a first side view of an embodiment of the disclosure.
Figure 6:
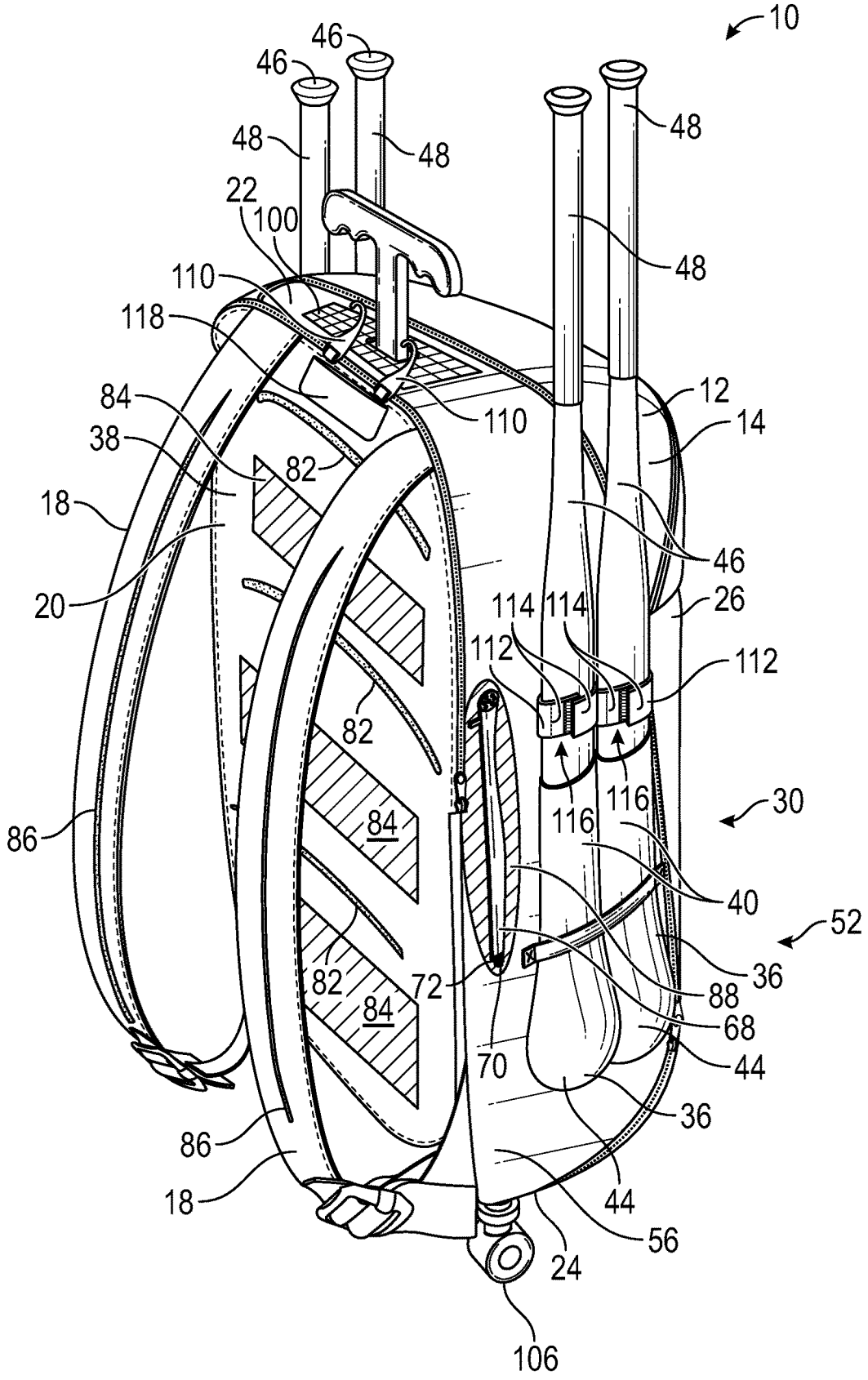
FIG. 6 is a perspective in-use view of an embodiment of the disclosure.
Figure 7:
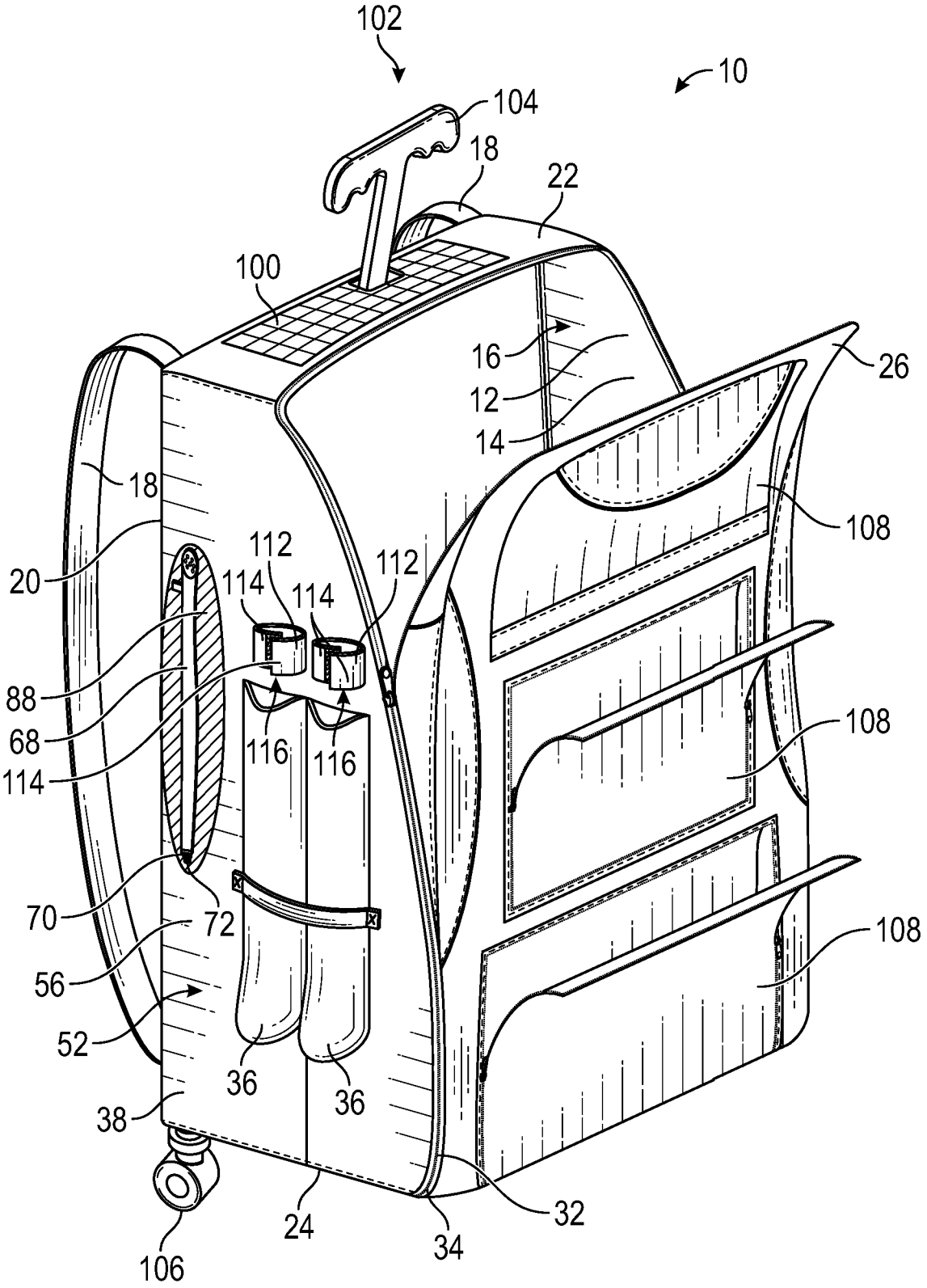
FIG. 7 is a top front side perspective view of an embodiment of the disclosure.
Figure 8:
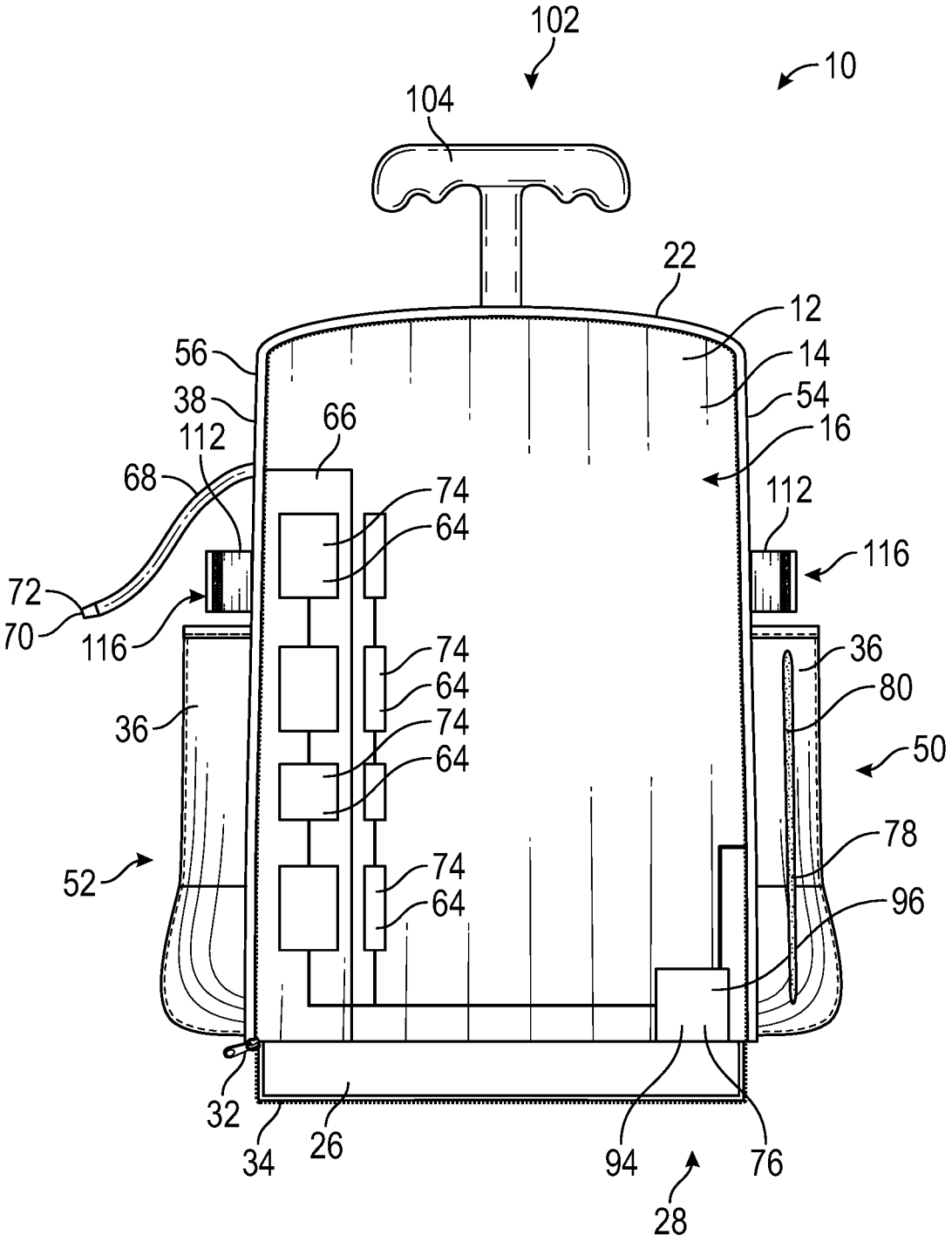
FIG. 8 is a front view of an embodiment of the disclosure with a front panel in an open position.
Figure 9:
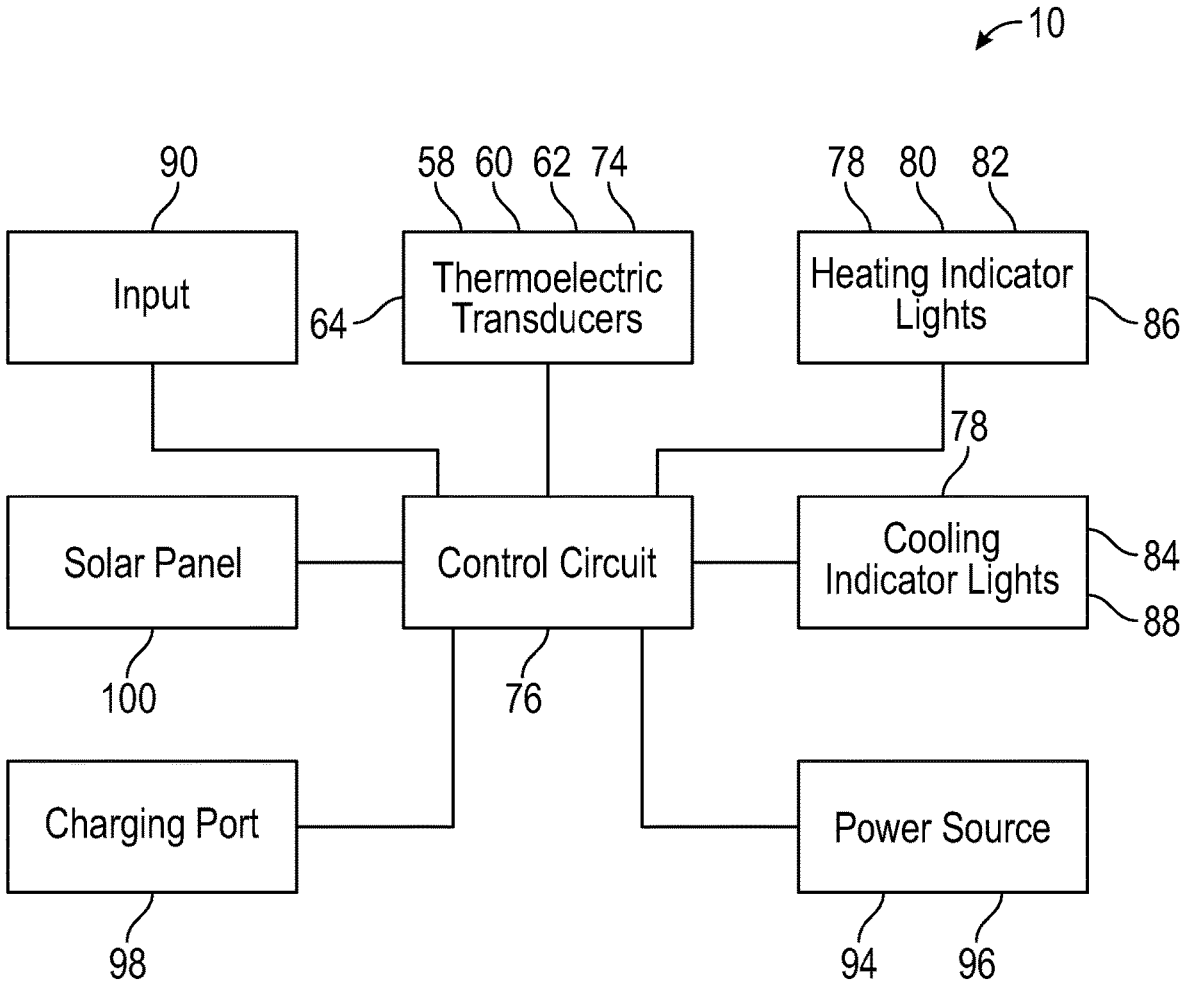
FIG. 9 is a block diagram of an embodiment of the disclosure.

With reference now to the drawings, and in particular to FIGS. 1 through 9 thereof, a new sports equipment bag embodying the principles and concepts of an embodiment of the disclosure and generally designated by the reference numeral 10 will be described.

As best illustrated in FIGS. 1 through 9, the heating and cooling backpack apparatus 10 generally comprises a body 12 having an outer shell 14 which defines an interior space 16. Each of a pair of carrying straps 18 is coupled to and extends outwardly from the body 12. Each carrying strap 18 extends from a back side 20 of the body 12 adjacent to a top side 22 of the body 12 to the back side 20 adjacent to a bottom side 24 of the body 12. A front panel 26 of the outer shell 14 is movable between an open position 28 which exposes the interior space 16 and a closed position 30 which covers the interior space 16. A fastener 32 such as a zipper 34, hook-and-loop connector, latch, or the like releasably secures the front panel 26 in the closed position 30.

Each of a plurality of bat sleeves 36 is coupled to an outer surface 38 of the body 12. Each bat sleeve 36 comprises a tubular panel 40 and has an open top 42 and a closed bottom 44. Each bat sleeve 36 is configured for holding a baseball bat 46 such that the baseball bat 46 extends upwardly from the bat sleeve 36 and a bat handle 48 of the baseball bat 46 is positioned distally from the bat sleeve 36. The term "baseball bat" as used in the specification and the claims includes softball bats, cricket bats, and like sports equipment. The plurality of bat sleeves 36 includes a first pair 50 of bat sleeves 36 and a second pair 52 of bat sleeves 36. Each bat sleeve 36 of the first pair 50 of bat sleeves 36 is positioned on a first lateral side 54 of the body 12. Each bat sleeve 36 of the second pair 52 of bat sleeves 36 is positioned on a second lateral side 56 of the body 12.

Each of a pair of bat heaters 58 is coupled to an associated bat sleeve 36 of the first pair 50 of bat sleeves 36. Each bat heater 58 is coupled to the tubular panel 40 of the associated bat sleeve 36 and may be embedded within the tubular panel 40 of the associated bat sleeve 36. Each bat heater 58 selectively heats the associated bat sleeve 36. A back heater cooler 60 is coupled to the back side 20 of the body 12. The back heater cooler 60 is embedded within the outer shell 14, selectively heating and selectively cooling the outer surface 38 of the body 12 across the back side 20. Each of a pair of strap heaters 62 is coupled to an associated carrying strap 18 of the plurality of carrying straps 18, and each strap heater 62 selectively heats the associated carrying strap 18. The bat heaters 58 and the strap heaters 62 comprise thermoelectric heat pumps 64 but may comprise electric resistance heaters or the like.

The back heater cooler 60 also comprises a thermoelectric heat pump 64 which operates to pump heat toward or away from the outer surface 38 of the body 12 to heat or cool the outer surface 38 respectively. The back heater cooler 60 may alternatively comprise separate elements for heating and cooling. For example, the back heater cooler 60 may comprise an electric resistance heater for heating the outer surface 38 and a refrigeration system for cooling it. Alternatively, the back heater cooler 60 may comprise an air circulation system for cooling the outer surface 38 which urges one of ambient air and air contained within the body 12 against the body 12 to cool the outer surface 38. This arrangement would cool the outer surface 38 when the outer surface 38 has a temperature greater than a temperature of the air urged against the outer surface 38, including, for example, when a user warms the outer surface 38 with their body 12 heat.

A drink reservoir 66 configured for containing a fluid is coupled to the body 12 and is positioned within the interior space 16. A hose 68 is in fluid communication with the drink reservoir 66. The hose 68 extends through the outer shell 14 of the body 12 and outwardly from the body 12. The hose 68 has a nozzle 70 on a free end 72 of the hose 68 for dispensing the fluid. A reservoir cooler 74 is coupled to the drink reservoir 66 and selectively cools the drink reservoir 66. The reservoir cooler 74 is configured for selectively cooling the fluid when the fluid is contained within the drink reservoir 66. The reservoir cooler 74 comprises a thermoelectric heat pump 64 but may comprise a refrigeration system, an air circulation system similar to what is described above for the back heater cooler 60, or the like.

A control circuit 76 is coupled to the body 12 and is positioned within the interior space 16. The control circuit 76 is electrically coupled to each bat heater 58, the back heater cooler 60, each strap heater 62, and the reservoir cooler 74. Each of a plurality of indicator light emitters 78 is electrically coupled to the control circuit 76. Each indicator light emitter 78 is configured to emit light away from the body 12 when activated. The plurality of indicator light emitters 78 includes a pair of bat heating indicators 80, a back heating indicator 82, a back cooling indicator 84, a pair of strap heating indicators 86, and a reservoir cooling indicator 88.

Each bat heating indicator 80 is coupled to a respective bat sleeve 36 of the first pair 50 of bat sleeves 36. Each bat heating indicator 80 activates when the respective bat sleeve 36 is being heated by the bat heater 58 associated with the respective bat sleeve 36. The back heating indicator 82 is coupled to the back side 20 of the body 12 and activates when the back heater cooler 60 is heating the outer surface 38 of the body 12. The back cooling indicator 84 is coupled to the back side 20 of the body 12 and activates when the back heater cooler 60 is cooling the outer surface 38 of the body 12. Each strap heating indicator 86 is coupled to a respective carrying strap 18 of the pair of carrying straps 18 and activates when the respective carrying strap 18 is being heated by the strap heater 62 associated with the respective carrying strap 18. The reservoir cooling indicator 88 is coupled to the body 12 adjacent to the hose 68 and activates when the reservoir cooler 74 is cooling the drink reservoir 66.

An input 90 is electrically coupled to the control circuit 76 and selectively directs the control circuit 76 to activate one of each bat heater 58, the back heater cooler 60, each strap heater 62, and the reservoir cooler 74. The input 90 may be coupled to the body 12 and is positioned on the first lateral side 54 of the body 12. The input 90 may also comprise a switch 92 for selecting an off mode, a heating mode, and a cooling mode. The off mode comprises each bat heater 58, the back heater cooler 60, each strap heater 62 and the reservoir cooler 74 are deactivated. The heating mode comprises each bat heater 58, the back heater cooler 60, and each strap heater 62 heating. And the cooling mode comprises the back heater cooler 60 and the reservoir cooler 74 cooling. The input 90 may alternatively communicate wirelessly with and remotely from the control circuit 76. The input 90 may also comprise a touchscreen, buttons, dials, or the like. In some embodiments, the input 90 controls each bat heater 58, the back heater cooler 60, each strap heater 62, and the reservoir cooler 74 individually and includes the option to cool the water reservoir with the reservoir cooler 74 while heating elsewhere with one of each bat heater 58, the back heater cooler 60, and each strap heater 62.

A power source 94 is electrically coupled to the control circuit 76 and is positioned in the interior space 16. The power source 94 comprises a battery 96. Each of a pair of charging ports 98 is electrically coupled to the control circuit 76. Each charging port 98 is configured for one of coupling to an external power supply for charging the battery 96 and coupling to an electronic device for charging the electronic device with the battery 96. Each charging port 98 is coupled to the body 12 and is positioned on the first lateral side 54. A solar panel 100 is electrically coupled to the control circuit 76 and is configured for converting solar radiation into electricity. The solar panel 100 is coupled to the body 12 and is positioned on the top side 22.

A bag handle 102 is telescopically coupled to the top side 22 of the body 12 adjacent to the back side 20. The bag handle 102 is movable between a retracted position and an extended position. The bag handle 102 comprises an elongated grip 104 that is oriented laterally with respect to the body 12. A pair of laterally spaced wheels 106 are coupled to and extend downwardly from the bottom side 24 of the body 12. Pockets 108 may be positioned across the outer surface 38 for storing items. Mounting hooks 110 are coupled to the back side 20 of the body 12 adjacent to the top side 22 for hanging the heating and cooling backpack apparatus 10. A pouch 118 is also coupled to the back side 20 of the body 12 adjacent to the top side 22 which is also positioned adjacent to the mounting hooks 110 so that the mounting hooks 110 can be stored within the pouch 118. Each of a plurality of straps 112 is coupled to one of the first lateral side 54 and the second lateral side 56 adjacently above an associated one of the bat sleeves 36. Each strap 112 has a pair of free ends 114 which are joinable with each other to wrap the strap 112 around the baseball bat 46 when the baseball bat 46 is stored in a selected one of the plurality of bat sleeves 36 to secure the baseball bat 46 in the selected bat sleeve 36. The free ends 114 may be joinable via a hook-and-loop fastener 116, button, snap, buckle, or the like.

In use, the heating and cooling backpack apparatus 10 stores items in the interior space 16 and in the pockets 108. A fluid such as a beverage may be contained in the drink reservoir 66. Baseball bats 46 and like sports equipment may be stored in the bat sleeves 36 as described above and secured in place using the straps 112. To heat the stored sports equipment, the input 90 is actuated to activate a bat heater 58 coupled to the bat sleeve 36 where the sports equipment is stored. To cool the fluid in the drink reservoir 66, the input 90 is actuated to activate the reservoir cooler 74. The input 90 may also be actuated to activate the back heater cooler 60 to heat or cool the outer surface 38 of the body 12 across the back side 20 of the body 12 and may be actuated to activate the strap heaters 62 to heat the straps 112. By heating and cooling the outer surface 38 of the body 12 across the back side 20, the outer surface 38 may provide a comfortable temperature for a user who holds or carries the heating and cooling backpack apparatus 10 against their clothes or skin. Embodiments with the bag handle 102 and the wheels 106 may be used to move the heating and cooling backpack apparatus 10 along a support surface by grasping the elongated grip 104 and moving the bag handle 102 while the wheels 106 engage the support surface.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A heating and cooling backpack apparatus comprising:

a body having an outer shell, said outer shell defining an interior space;

a carrying strap being coupled to and extending outwardly from said body, said carrying strap extending from a back side of said body adjacent to a top side of said body to said back side of said body adjacent to a bottom side of said body;

a back heater cooler being coupled to said back side of said body, said back heater cooler selectively heating and selectively cooling said outer surface of said body across said back side;

a control circuit being coupled to said body and being positioned within said interior space, said control circuit being electrically coupled to said back heater cooler;

a bat sleeve being coupled to an outer surface of said body, said bat sleeve comprising a tubular panel, said bat sleeve having an open top and a closed bottom, said bat sleeve being configured for holding a baseball bat; and a bat heater, said bat heater being coupled to said bat sleeve, said bat heater selectively heating said bat sleeve, said control circuit being electrically coupled to said bat heater.

2. The apparatus of claim 1, further comprising said back heater cooler being embedded within said outer shell, said back heater cooler comprising a thermoelectric heat pump.

3. The apparatus of claim 1, further comprising an input being electrically coupled to said control circuit, said input selectively directing said control circuit to activate said bat heater and said back heater cooler, said input comprising a switch for selecting an off mode, a heating mode, and a cooling mode, said off mode comprising each of said bat heater and said back heater cooler being deactivated, said heating mode comprising each of said bat heater and said back heater cooler heating, said cooling mode comprising said back heater cooler cooling.

4. The apparatus of claim 1, further comprising said bat heater being embedded within said tubular panel of said bat sleeve, said bat heater comprising a thermoelectric heat pump.

5. The apparatus of claim 1, further comprising a bat heating indicator, said bat heating indicator being coupled to said bat sleeve, said bat heating indicator being electrically coupled to said control circuit, said bat heating indicator being configured to emit light away from said body when activated, said bat heating indicator activating when said bat sleeve is being heated by said bat heater.

6. The apparatus of claim 1, further comprising:

a back heating indicator, said back heating indicator being coupled to said back side of said body, said back heating indicator being electrically coupled to said control circuit, said back heating indicator being configured to emit light away from said body when activated, said back heating indicator activating when said back heater cooler is heating said outer surface of said body; and a back cooling indicator, said back cooling indicator being coupled to said back side of said body, said back cooling indicator being electrically coupled to said control circuit, said back cooling indicator being configured to emit light away from said body when activated, said back cooling indicator activating when said back heater cooler is cooling said outer surface of said body.

7. The apparatus of claim 1, further comprising a strap heater being coupled to said carrying strap, said strap heater selectively heating said carrying strap, said strap heater being electrically coupled to said control circuit.

8. The apparatus of claim 7, further comprising said strap heater comprising a thermoelectric heat pump.

9. The apparatus of claim 7, further comprising said input comprising a switch for selecting an off mode, a heating mode, and a cooling mode, said off mode comprising each of said bat heater, said back heater cooler, and said strap heater being deactivated, said heating mode comprising each of said bat heater, said back heater cooler, and said strap heater heating, said cooling mode comprising said back heater cooler cooling.

10. The apparatus of claim 7, further comprising a strap heating indicator, said strap heating indicator being coupled to said carrying strap, said strap heating indicator being electrically coupled to said control circuit, said strap heating indicator being configured to emit light away from said body when activated, said strap heating indicator activating when said strap heater is heating said carrying strap.

11. A heating and cooling backpack apparatus comprising:

a body having an outer shell, said outer shell defining an interior space;

a carrying strap being coupled to and extending outwardly from said body, said carrying strap extending from a back side of said body adjacent to a top side of said body to said back side of said body adjacent to a bottom side of said body;

a back heater cooler being coupled to said back side of said body, said back heater cooler selectively heating and selectively cooling said outer surface of said body across said back side;

a control circuit being coupled to said body and being positioned within said interior space, said control circuit being electrically coupled to said back heater cooler;

a drink reservoir being coupled to said body and being positioned within said interior space, said drink reservoir being configured for containing a fluid;

a hose being in fluid communication with said drink reservoir, said hose extending through said outer shell of said body and extending outwardly from said body, said hose having a nozzle on a free end of said hose for dispensing the fluid; and a reservoir cooler being coupled to said drink reservoir, said reservoir cooler selectively cooling said drink reservoir, said reservoir cooler being electrically coupled to said control circuit, said reservoir cooler being configured for selectively cooling the fluid when the fluid is contained within the drink reservoir.

12. The apparatus of claim 11, further comprising said reservoir cooler comprising a thermoelectric heat pump.

13. The apparatus of claim 11, said input comprising a switch for selecting an off mode, a heating mode, and a cooling mode, said off mode comprising each of said bat heater, said back heater cooler, and said reservoir cooler being deactivated, said heating mode comprising each of said bat heater and said back heater cooler heating, said cooling mode comprising said back heater cooler and said reservoir cooler cooling.

14. The apparatus of claim 11, further comprising a reservoir cooling indicator, said reservoir cooling indicator being coupled to said body adjacent to said hose, said reservoir cooling indicator being electrically coupled to said control circuit, said reservoir cooling indicator being configured to emit light away from said body when activated, said reservoir cooling indicator activating when said reservoir cooler is cooling said drink reservoir.

15. The apparatus of claim 1, further comprising a power source being electrically coupled to said control circuit and being positioned in the interior space, said power source comprising a battery.

16. The apparatus of claim 15, further comprising a charging port, said charging port being electrically coupled to said control circuit, said charging port being configured for one of coupling to an external power supply for charging said battery and coupling to an electronic device for charging the electronic device with said battery, each said charging port being coupled to said body and being positioned on said first lateral side.

17. The apparatus of claim 15, further comprising a solar panel being electrically coupled to said control circuit, said solar panel being configured for converting solar radiation into electricity, said solar panel being coupled to said body and being positioned on said top side.

18. A heating and cooling backpack apparatus comprising:

a body having an outer shell, said outer shell defining an interior space;

a pair of carrying straps, each said carrying strap being coupled to and extending outwardly from said body, each said carrying strap extending from a back side of said body adjacent to a top side of said body to said back side adjacent to a bottom side of said body;

a plurality of bat sleeves, each said bat sleeve being coupled to an outer surface of said body, each said bat sleeve comprising a tubular panel, each said bat sleeve having an open top and a closed bottom, each said bat sleeve being configured for holding a baseball bat, said plurality of bat sleeves including a first pair of bat sleeves and a second pair of bat sleeves, each said bat sleeve of said first pair of bat sleeves being positioned on a first lateral side of said body, each said bat sleeve of said second pair of bat sleeves being positioned on a second lateral side of said body;

a pair of bat heaters, each said bat heater being coupled to an associated bat sleeve of said first pair of bat sleeves, each said bat heater being coupled to said tubular panel of said associated bat sleeve, each said bat heater being embedded within said tubular panel of said associated bat sleeve, each said bat heater selectively heating said associated bat sleeve, each said bat heater comprising a thermoelectric heat pump;

a back heater cooler being coupled to said back side of said body, said back heater cooler being embedded within said outer shell, said back heater cooler selectively heating and selectively cooling said outer surface of said body across said back side, said back heater cooler comprising a thermoelectric heat pump;

a pair of strap heaters, each said strap heater being coupled to an associated carrying strap of said plurality of carrying straps, each said strap heater selectively heating said associated carrying strap, each said strap heater comprising a thermoelectric heat pump;

a drink reservoir being coupled to said body and being positioned within said interior space, said drink reservoir being configured for containing a fluid;

a hose being in fluid communication with said drink reservoir, said hose extending through said outer shell of said body and extending outwardly from said body, said hose having a nozzle on a free end of said hose for dispensing the fluid;

a reservoir cooler being coupled to said drink reservoir, said reservoir cooler selectively cooling said drink reservoir, said reservoir cooler being configured for selectively cooling the fluid when the fluid is contained within the drink reservoir, said reservoir cooler comprising a thermoelectric heat pump;

a control circuit being coupled to said body and being positioned within said interior space, said control circuit being electrically coupled to each said bat heater, said back heater cooler, each said strap heater, and said reservoir cooler;

a plurality of indicator light emitters, each said indicator light emitter being configured to emit light away from said body when activated, each said indicator light emitter being electrically coupled to said control circuit, said plurality of indicator light emitters including:

a pair of bat heating indicators, each said bat heating indicator being coupled to a respective bat sleeve of said first pair of bat sleeves, each said bat heating indicator activating when said respective bat sleeve is being heated by said bat heater associated with said respective bat sleeve;

a back heating indicator, said back heating indicator being coupled to said back side of said body and activating when said back heater cooler is heating said outer surface of said body;

a back cooling indicator, said back cooling indicator being coupled to said back side of said body and activating when said back heater cooler is cooling said outer surface of said body;

a pair of strap heating indicators, each said strap heating indicator being coupled to a respective carrying strap of said pair of carrying straps and activating when said respective carrying strap is being heated by said strap heater associated with said respective carrying strap; and a reservoir cooling indicator, said reservoir cooling indicator being coupled to said body adjacent to said hose and activating when said reservoir cooler is cooling said drink reservoir;

an input being electrically coupled to said control circuit, said input selectively directing said control circuit to activate one of each said bat heater, said back heater cooler, each said strap heater, and said reservoir cooler, said input comprising a switch for selecting an off mode, a heating mode, and a cooling mode, said off mode comprising each said bat heater, said back heater cooler, each said strap heater and said reservoir cooler being deactivated, said heating mode comprising each said bat heater, said back heater cooler, and each said strap heater heating, said cooling mode comprising said back heater cooler and said reservoir cooler cooling, said input being coupled to said body and being positioned on said first lateral side;

a power source being electrically coupled to said control circuit and being positioned in the interior space, said power source comprising a battery;

a pair of charging ports, each said charging port being electrically coupled to said control circuit, each said charging port being configured for one of coupling to an external power supply for charging said battery and coupling to an electronic device for charging the electronic device with said battery, each said charging port being coupled to said body and being positioned on said first lateral side; and a solar panel being electrically coupled to said control circuit, said solar panel being configured for converting solar radiation into electricity, said solar panel being coupled to said body and being positioned on said top side.

* * * * *